United States Patent [19]

Fraige

[11] Patent Number: 4,523,343

[45] Date of Patent: Jun. 18, 1985

[54] BUOYANT FIBER PRODUCT USED IN IMPROVED WATERBED FLOAT WITH HANGING BAFFLE

[76] Inventor: Richard Fraige, 11005 Hwy. 50 East, Carson City, Nev. 89701

[21] Appl. No.: 535,619

[22] Filed: Sep. 26, 1983

Related U.S. Application Data

[63] Continuation-in-part of Ser. No. 337,122, Jan. 5, 1982, Pat. No. 4,481,248.

[51] Int. Cl.[3] ..... A47C 27/08

[52] U.S. Cl. ..... 5/450; 5/451; 428/283; 428/311.5

[58] Field of Search ..... 5/450–451; 428/240, 283, 327, 311.5

[56] References Cited

U.S. PATENT DOCUMENTS

| | | | |
|---|---|---|---|
| 2,147,362 | 2/1939 | Bloomberg | 428/304.4 |
| 2,992,149 | 7/1961 | Drelich | 156/276 |
| 3,025,202 | 3/1962 | Morgan et al. | 428/317.9 |
| 3,037,897 | 6/1962 | Pelley | 264/46.2 |
| 3,050,427 | 8/1962 | Slayter et al. | 428/245 |
| 3,304,219 | 2/1967 | Nickerson | 428/327 |
| 3,325,338 | 6/1967 | Geen | 428/290 |
| 3,389,195 | 6/1968 | Giankos et al. | 428/304.4 |
| 3,598,672 | 8/1971 | Heller | 428/407 |
| 3,900,648 | 8/1975 | Smith | 428/317.9 |
| 3,952,126 | 4/1976 | Dycks | 428/283 |
| 4,021,589 | 5/1977 | Copley | 428/317.9 |
| 4,182,649 | 1/1980 | Isgur et al. | 428/240 |
| 4,301,560 | 11/1981 | Fraige | 5/450 |
| 4,357,386 | 11/1982 | Luciano et al. | 428/311.5 |
| 4,362,778 | 12/1982 | Andersson et al. | 428/304.4 |
| 4,399,575 | 8/1983 | Hall | 5/450 |
| 4,411,033 | 10/1983 | Morgan | 5/450 |

*Primary Examiner*—William J. Van Balen

*Attorney, Agent, or Firm*—Romney Golant Martin & Ashen

[57] ABSTRACT

Hydraulic chambers for attenuation of wave motion within waterbed mattresses are buoyed by unencapsulated material made by binding expanded foam beads to a garnetted fiber matrix.

20 Claims, 6 Drawing Figures

BUOYANT FIBER PRODUCT USED IN IMPROVED WATERBED FLOAT WITH HANGING BAFFLE

RELATED APPLICATIONS

This is a continuation in part of my copending application Ser. No. 337,122, filed Jan. 5, 1982, which has now issued as U.S. Pat. No. 4,481,248 and entitled "Buoyant Fiber Product and Method of Manufacturing Same".

BACKGROUND

1. Field of the Invention

This invention relates generally to waterbeds, and more particularly to systems for reducing undesirable wave motion within waterbed mattresses in response to movement of individuals sitting or lying on such mattresses.

This invention also relates generally to fiber products and to methods for their manufacture, and more particularly to a bonded buoyant fiber product useful in waterbed mattresses and to a method for its manufacture.

2. Prior Art (a) Waterbed antiwave systems—Some systems for reducing wave motion within waterbed mattresses use a baffle or baffles hung from a buoyant structure or structures. In some cases the baffle is contoured in various ways, and in particular when the baffle is contoured to form a closed or nearly closed structure it has been called a "hydraulic chamber". Hydraulic chambers have been supported by buoyant structures of various kinds, including buoyant pads, sheets or blocks of polyethylene foam. In all hanging-baffle systems, wave energy is expended (against internal friction of the water) in moving the baffle—and, more importantly, in moving as a unit a body of water that is behind or within the baffle.

Such buoyant structures, with hanging baffles attached, help to inhibit formation as well as propagation of waves within the mattress. They also impart a relatively firm "feel", since they float immediately below and in contact with the mattress top panel, and so can be felt by a user/occupant. Many users prefer this firm "feel"; however, generally they do not like to feel the buoyant structure itself or the baffle itself, so a layer of fiber is generally or often added on the top of the buoyant structure.

Other systems make use of fibrous mats placed within waterbed mattresses to absorb the energy of water motion caused by occupant movement; this is the subject of my U.S. Pat. No. 4,301,560, and is discussed in more detail in subsection (b), below. In these latter systems energy is absorbed by the fibrous structure of the matting. This approach to reducing wave motion can be used to provide a relatively soft "feel," preferred by some users. This kind of "feel" generally results from using fiber that is not significantly buoyant; my U.S. Pat. No. 4,301,560 is not limited to providing this softer "feel."

Yet other systems combine these two effects. That is, they employ some combination structure that offers both (1) buoyancy to support a hydraulic chamber or other hanging baffle, and (2) the capability of absorbing the flow energy or wave energy of water flowing through the structure. In some cases a polyethylene foam sheet or block one-eighth to one-quarter of an inch thick is laminated into the middle of a fiber matting two to six inches thick, to produce such a combined buoyant and energy-absorbing structure. In other cases the foam is placed only below the fiber.

These systems, however, are rather exceptional, the most prevalent being only buoyant structures. Such "only-buoyant" structures are entirely without fiber—except for the thin layer of fiber that is generally placed atop the buoyant structure to prevent its being felt by the user, as previously mentioned. This layer is typically a half-inch to an inch thick.

These various configurations strongly affect the "feel" of the finished mattress, and as already noted different users typically prefer different configurations. On an objective level, however, the solid polyethylene foam pad that is common to all the configurations has several drawbacks:

(1) It interferes with convection currents and thus with effective thermostatting at the area of contact with the occupant of the bed.

(2) It also acts as a reservoir for tiny air bubbles, releasing them a few at a time over a long period of time—and thus requiring the user to bleed them out of the mattress for a relatively long time.

(3) It also interferes with the access of water to the mattress valve when the bed is drained.

(4) The diminished convection currents can also interfere with proper circulation of water-treatment chemicals within the mattress, thereby increasing the likelihood of bacteria and the like growing in the obstructed areas. The result can be both objectionable odor and degradation of the vinyl.

A hydraulic chamber is a preferably nonwatertight inner compartment which damps undesirable waves by the inertia of enclosed water. Because it is vented, a hydraulic chamber allows relatively slow inward and outward water flow, to accommodate filling—and to accommodate relatively slow shifts of water distribution, thereby helping the waterbed mattress to adjust to the position of a person lying on the bed. The unsealed apertures in the chamber are small enough, however, to cause the chamber to behave essentially as a unit in response to transients caused by relatively abrupt motions of the occupant. It is this latter effect that resists and thereby reduces the undesirable wave motion.

A hydraulic chamber is hung from a buoyant pad or other "float" within the mattress. Typically the pad floats just below the upper panel of the mattress, and the chamber hangs downward toward (but generally not all the way to) the bottom panel of the mattress.

Prior buoyant pads used to support hydraulic chambers have been made of polyethylene. Unfortunately, even closed-cell polyethylene has a tendency to slowly waterlog and eventually sink. A representative of the Dow Chemical Company, which manufactures this material, has explained to me:

> "Under long-term submersion conditions, polyethylene foam sheet can be expected to pick up some quantity of water, even though the foam has a closed-cell structure. This is due to the slow migration of individual water molecules into and through the polyethylene cell walls. The buoyant force exerted by the foam would, of course, decrease as more and more water molecules make their way into the foam."

This manufacturer estimated the length of time required for this effect to become significant, under conditions pertinent to waterbeds, as "certainly a number of months and possibly several years," and went on to say "we have no data that would allow us to refine this further." I have heard reports of hydraulic-chamber floats waterlogging and sinking in as short a time as eight months, and even six.

Besides forfeiting its antiwave characteristics, a chamber or other continuous structure which sinks can also obstruct convection at the waterbed heater and thermostat. Depending on the geometry and on the electrical circuitry of these devices, various adverse conditions may result—such as causing the thermostat and heater to cycle on and off frequently, and/or to wear out entirely; and/or causing the heater to stay off continuously or to stay on continuously. In the last-mentioned case, accumulated heat could damage the mattress and liner, possibly even releasing the water from the mattress and causing water damage to the premises in which the mattress is installed.

Some mitigation of the uptake of water by polyethylene foam may be obtained by using relatively high-density foam. High-density foam presents a greater number of cell walls through which water must migrate to occupy the foam. Unfortunately, however, any material with higher density has correspondingly lower buoyancy, and polyethylene foam is no exception. Thus the manufacturer using floats made of polyethylene foam has a choice of providing *brief* buoyancy or *lower* buoyancy! The cost, weight and bulk implications of the latter are apparent. Bulk, in particular, is undesirable since it places a lower limit on the overall size of the unfilled waterbed mattress for shipment and storage.

One seductive solution to this problem is to encapsulate the polyethylene foam pad in vinyl—or in some other sheeting similar to that used for the mattress proper. There are at least two drawbacks to this solution.

First, the encapsulation tends to aggravate the tendency of polyethylene pads to obstruct heat flow vertically within the mattress. This obstruction prevents the thermostatted waterbed heater (in conjunction with convective circulation) from controlling the water temperature as felt by the occupant of the bed. To overcome this problem one may manufacture the pad and its encapsulation with multiple apertures—but this substantially increases the number of separate welded seams, and thus the labor and the manufacturing cost.

Second, encapsulation forecloses any possibility of using the structure of the buoyant pad itself for wave absorption; however, since satisfactory buoyant pads of fibrous material have not previously been available, this possibility has not been significant before now.

(b) Fiber products—Polyester fiber has many applications, including use in waterbed mattresses for the purpose of inhibiting wave motion. Developments in this area are set forth in my U.S. Pat. No. 4,301,560, entitled "Waterbed Mattress", which issued Nov. 24, 1981, and is hereby incorporated by reference. As shown in that patent, bonded nonwoven polyester fiber disposed within a waterbed mattress very effectively reduces undesirable wave motion.

One very undesirable form of wave motion occurs near the upper surface of the mattress. This portion of the wave motion can be inhibited by positioning the fiber in the upper part of the mattress, using appropriate means. One way to accomplish this is to fill substantially all of the mattress with the fiber. The fiber, which is nonbuoyant, rests on the bottom, inner surface of the mattress and extends upward into the upper portions of the mattress.

Although wave motion can be effectively reduced in the manner described above, the necessity of filling substantially all of the mattress with the fiber is a serious drawback. The large required amount of fiber increases the shipping size and weight of the mattress and, more importantly, significantly increases the cost of manufacturing the mattress. Handling and storage are likewise adversely affected.

Another way to position fiber in the upper part of the mattress is to render the bonded fiber buoyant in some manner. (The term "buoyant" as used in this document means buoyant in water.) As already mentioned, one prior-art approach is to construct a laminated fiber pad composed of an upper layer of fiber, a middle layer of buoyant foam material, and a lower layer of fiber. The buoyant foam material can be either a thin foam pad or a thin layer of foam beads. The laminated pad is held together by suitable adhesives, stitching, riveting and other similar methods.

Such prior-art buoyant laminated pads are effective in suppressing wave motion. However, such pads are subject to a high rate of failure by delamination, apparently due to the high forces encountered in use. They are also relatively expensive to manufacture because of the large amount of manual labor required in the manufacture.

Another prior-art attempt to produce a buoyant fiber product involves the use of polypropylene fiber. This fiber, unlike polyester fiber, is buoyant in water. Unfortunately, however, if polypropylene fiber is made into a unitary matting by means of a commonly used bonding agent such as acrylic latex, the buoyancy of the fiber is reduced and may be rendered inadequate. Experiments have been conducted with buoyant bonding agents, but it is not believed that any of such experiments have been successful.

The prior art thus has failed to provide a buoyant fiber product (or any other means) that is reliably effective and practical for the reduction of wave motion in waterbed mattresses.

SUMMARY OF THE INVENTION

1. Fibrous Product and Method of Manufacture

My invention provides a new buoyant fiber product that is both effective and practical for the reduction of wave motion in waterbed mattresses. My invention also provides a new manufacturing method for producing that product.

The fiber product is a highly lofted fibrous structure composed of a large multiplicity of fibers together with a large multiplicity of buoyant particles. A binder is disposed over the fibers in such a way that substantially each fiber is bound to at least one other fiber. The same binder is disposed over the buoyant particles, in such a way that substantially each particle is bound to at least one of the fibers. The buoyant particles are present in sufficient numbers to render the fiber product as a whole buoyant.

The buoyant fiber product is manufactured by combining a binder, a quantity of fibrous material, and a quantity of buoyant particles. As preferred examples, the binder may be acrylic latex, the fibrous material may be polyester fibers, and the particles may be foam beads—preferably polystyrene, since that is a material that I have learned is far less subject to waterlogging than buoyant substances used in prior-art buoyant pads and the like. The particles may either be buoyant when added to the fibrous material, or become buoyant upon or after application of heat.

In this novel structure the fibers may be randomly intertwined or interbonded, or alternatively if desired may be woven.

Conventional automated assemby lines for producing nonbuoyant bonded fiber can be readily and easily adapted to practice this new method, and thereby to manufacture my new fiber product. Essentially no manual labor is required; therefore, the cost of manufacturing the buoyant fiber does not greatly exceed that of bonded nonbuoyant fiber

2. Use as Wave Absorber

The fibrous product described above may be placed directly within a waterbed mattress, where it will float near the top (providing a firm sleeping surface) and impede the flow of water. Water within the mattress flows directly through the fibrous product, but the energy of the flow is expended against internal friction of the water in doing so—particularly for rapid flow.

When a person sits down or lies down on the waterbed, or subsequently moves on the bed, sits up on the bed, or starts to get out of the bed, these movements transfer energy to the water within the waterbed mattress and thereby create waves within the mattress. The energy in the waves, however, is quickly expended in flowing through the fibrous product within the mattress; accordingly the objectionable wave action as felt by the user of the bed is greatly diminished. If buoyancy is provided, the wave encounters the buoyant fibrous product immediately at formation, and the product therefore resists the *initiation* of the shock wave, dispersing the energy along the surface—as well as providing a firmer sleeping surface, which some users prefer.

3. Float with Hanging Baffle

In a preferred embodiment of my invention, the fibrous product after manufacture is incorporated into a partially enclosed vinyl or like plastic sheeting structure, for use within an otherwise generally conventional waterbed mattress. In use, water fills both the mattress and the space in and around the sheeting structure.

One portion of the sheeting structure forms a hanging baffle—and particularly such a baffle configured as a hydraulic chamber. Another portion of the sheeting structure constrains the fibrous product in close proximity to the baffle, preferably above the baffle, so that the fibrous product can by its buoyancy support the baffle structure. The constraint, however, is not so complete as to prevent some circulation of water through the fibrous product as well as around the baffle (or through the hydraulic chamber, if that type of baffle is used).

In other words, the fibrous product both:

(1) supports the hydraulic chamber, to provide the antiwave characteristic of the chamber, and (2) itself is partially exposed to the circulation of water within the waterbed mattress and thereby is situated to slightly dampen such circulation in the manner described in my previously mentioned U.S. Pat. No. 4,301,560.

The hydraulic chamber and the portion of the sheeting structure that constrains the fibrous product in close proximity to the chamber are both open to air and water circulation within the mattress. This open configuration serves several purposes: it provides the second characteristic just described, it lets air bubbles out when the mattress has recently been filled, it lets water out when the mattress is being drained, and it maximizes the thermal transparency of the structure, thereby enhancing effective and uniform thermostatted heating of the water in the mattress. Finally, the open configuration provides sufficient water motion for effective circulation of water-treatment chemicals throughout the mattress. Such circulation retards the growth of bacteria, fungus and the like, which otherwise can produce unpleasant odors and even degradation of the vinyl.

All of the foregoing principles and advantages of the present invention, and others not yet presented, will be more fully appreciated upon consideration of the following detailed description, with reference to the appended drawings, of which:

BRIEF DESCRIPTION OF THE DRAWINGS

FIG. 5 shows the thicknesses of the sheeting elements exaggerated relative to other dimensions in the drawing.

DETAILED DESCRIPTION OF THE INVENTION

1. Method of Manufacture

Figure 1:
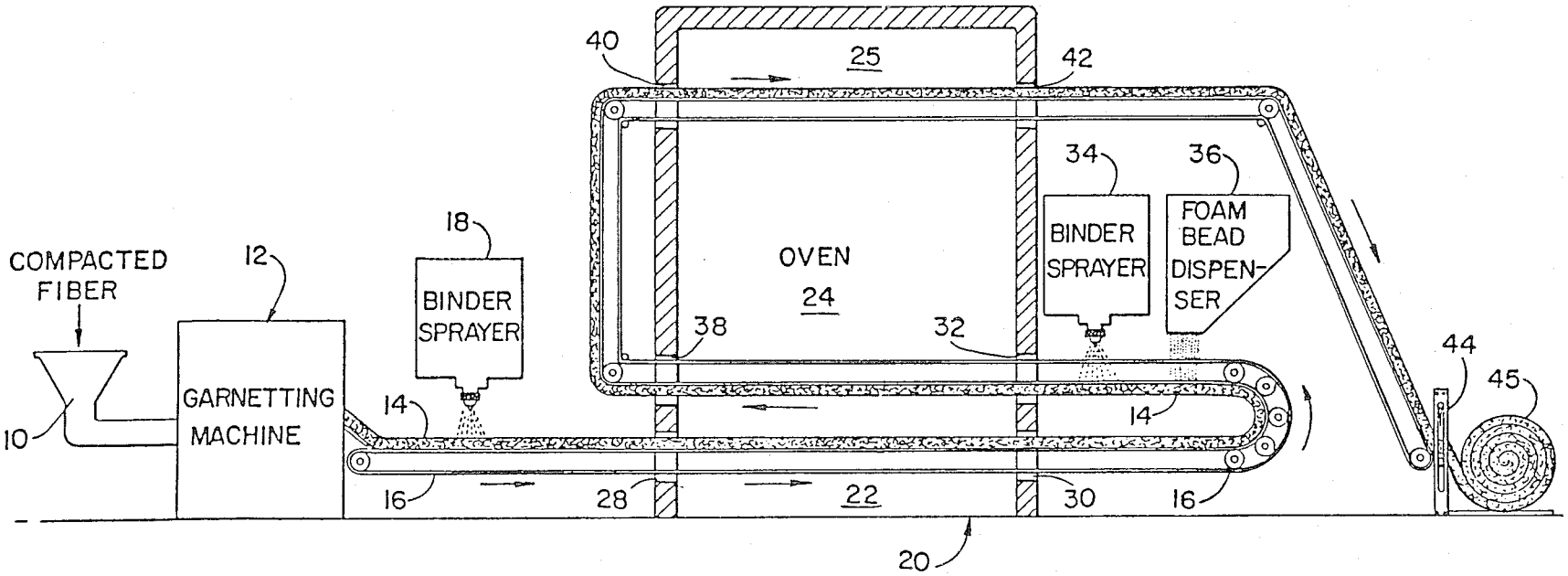
FIG. 1 is a simplified schematic representation of the novel method which I prefer to use in manufacturing the fiber product of my invention.

As shown in FIG. 1, the manufacturing process begins with the introduction of an unbonded fiber into the hopper 10 of a conventional garnetting machine, generally designated by the reference numeral 12. I prefer to use polyester fiber, but fibers of other materials may be acceptable. For ease of handling, the fiber should be in staple form rather than continuous, with the length of the individual fibers being approximately one to three inches. A fiber of fifteen to one hundred denier (a commonly used measure of fiber fineness) has been found to be acceptable in waterbed applications. However, a combination of seventy-five percent fiber that is forty denier and twenty-five percent fiber that is fifteen denier produces a superior product for this application.

A conventional garnetting machine (sometimes referred to as a "garnett") 12 is provided with a series of grooved rollers which shread, tear and comb the compacted fiber to form a continuous stream 14 of lofted fiber that has relatively uniform density, thickness and width.

In this document, as generally in dictionary definitions, common usage, and trade usage, the term "lofted" means the opposite of "compressed"—that is to say, it conveys generally the same idea as "expanded" or "raised" or "puffed up". This concept is to be understood as compatible with *either* a woven regular structure, or a generally random intertwined and/or interbonded structure.

The garnetting machine 12 is set to provide a continuous lofted fiber stream whose initial thickness is often roughly four inches. This thickness, however, is commonly called "false loft," because after further processing (to be described) the fiber stream will contract (or compact) to a thickness of only about three-eighths inch to two inches. The weight of a two-inch-thick lofted fiber (after contraction) is preferably on the order of one and one-half ounces per square foot—or, in other words, such a finished stream of lofted fiber has a density on the order of nine ounces per cubic foot. The width of the fiber stream is varied to suit the size of the waterbed mattress in which the final product is to be installed: a typical width is approximately sixty inches.

A conveyor chain 16 receives the unbonded fiber stream 14 leaving the garnetting machine and delivers the fiber to a conventional sprayer 18—the first of two sprayers in the apparatus. This first sprayer 18 applies "binder" (or, as it is sometimes called, "adhesive") to the fiber as an uncured or partially cured liquid. The binder sprayer 18 typically reciprocates across the width of the fiber stream 14, to coat the upper portion of the fiber uniformly. The liquid binder trickles down through the fiber stream 14, so that the number of fibers which are at least partially covered by the binder is a large fraction of the total number of fibers. After this first spraying the fiber stream is typically two and a half inches thick, but there can be large variations between thicknesses in different operations.

The binder is preferably a cross-linking acrylic emulsion such as the binder marketed by Union Carbide of New York, N.Y. under the trademark "UCAR LATEX 879." The Rohm and Haas Company of Philadelphia, Pa. also markets a suitable binder under the trademark "Rhoplex TR-407." The binder should be diluted with a water solvent, as recommended by the manufacturer, to permit spraying. Binders utilizing nonaqueous solvents are not preferred.

The fiber carrying the uncured or partially cured binder proceeds to a conventional drying and curing oven, generally designated by the numeral 20. The fiber makes three passes through the oven on the conveyor chain 16. The heat of the oven evaporates the water solvent of the binder and cures the binder. The path length of each pass through the oven is roughly thirty feet, and the conveyor chain 16 moves roughly thirty feet per minute. Accordingly the drying and curing time in the oven is roughly one minute per pass, for a total of three minutes.

Oven 20 has three thermostats, which are used for controlling the oven temperature independently in the three areas 22, 24, and 26 adjacent the conveyor chain 16. Optimum results have been achieved by maintaining the oven temperature in the three areas at approximately 225° F. Typical curing temperature for conventional bonded nonbuoyant fiber is somewhat higher—generally on the order of 275° F.

The conveyor chain 16 first enters the oven 12 through a first entrance at 28 and leaves through a corresponding exit at 30. During this first pass through the oven, the binder applied by the sprayer 18 is partially dried and cured. The conveyor 16 turns and, preferably inverted as shown, reenters the oven at another entrance 32.

While the conveyor and fiber are outside the oven, however, unexpanded foam beads are dispensed over the fiber stream 14 by a dispenser 36. Unexpanded polystyrene foam beads which expand up to approximately one-sixteenth to one-eighth inch in diameter upon application of heat are preferred. It is also preferable that the foam beads contain some form of fire retardant. (As the term is used in this document, an "unexpanded foam bead" is a bead which expands to at least triple its unexpanded diameter upon or after application of heat.) Unexpanded foam beads manufactured by BASF Wyandotte Corporation of Wyandotte, Mich. under the trademark "STYROPOR" have been found suitable. Another supplier of unexpanded foam beads is ARCO Polymers of Los Angeles, Calif.

The dispenser 36 dispenses the foam beads evenly over the surface of the fiber stream at a predetermined rate. Ordinary fertilizer spreaders, literally of the "garden variety," have been found suitable for this purpose. A single spreader can dispense beads in a flow twenty inches wide. In order to cover the entire sixty-inch width of the fiber stream 14, three spreaders are positioned adjacent one another over the conveyor chain 16. The three spreaders are driven by a common gear drive, with a gear ratio selected to achieve the desired rate of bead delivery. Additional spreaders can be added to the bead dispenser in order to accommodate fiber streams having widths greater than sixty inches.

It is preferable that the dispenser 36 include a separate on/off mechanism so that, if conventional nonbuoyant bonded fiber is desired, the assembly line can be converted for that purpose by simply shutting down the dispenser 36. A slight increase in oven temperature may be required.

A second binder sprayer 34, similar to the first sprayer 18, sprays additional binder through the conveyor chain 16 and onto the opposite side of the fiber stream 14. This second application of binder, which also trickles down through the fiber stream, ensures that substantially all of the fibers are at least partially coated with binder.

The small-diameter unexpanded foam beads applied by the bead dispenser 36 have a tendency to drift down into the interior of the fiber stream 14, under the influence of gravity. The uncured binder sprayed by sprayer 34 also tends to drive the beads down into the fiber.

One advantage of this propulsion of the beads into the bulk of the fiber is that they are removed from the immediate surface of the lofted fiber and thereby removed from contact with various vinyl structures that will be near the fiber in use, in various applications. Polystyrene can degrade vinyl, especially under conditions of long exposure with intimate contact and temperature substantially above normal room temperature. Hence it is worthwhile to consider ways of avoiding intimate contact between the beads and the vinyl, as by positioning the beads well within the fibrous matting.

Substantially all of the foam beads are at least partially covered with the liquid binder. This at-least-partial coating may be advantageous in that it forms a barrier between the polystyrene foam and the vinyl. Such a coating may further aid in reducing the intimate contact mentioned above, and thereby in minimizing degradation of the vinyl.

It is preferable to dispense the beads over the fiber stream immediately prior to this final binder spraying—not only because the force of the sprayed binder encourages the unexpanded beads toward the center of the fiber stream, but also because the sprayed binder coats the beads and secures the beads to the fiber upon curing. In any event, the beads should be introduced at some point before final spraying of the binder so that the liquid binder will cause substantially each bead to bond to at least one fiber, respectively.

It is after this second spraying that the fiber matting will be found to have a thickness of three-eighths inch to two inches, and typical density (at two-inch thickness) of nine ounces per cubic foot.

The fiber stream 14 reenters the oven at a second entry point 32. The heat of the oven here begins to dry and cure the newly added binder, and it also further dries and cures the original binder. Moreover, the heat causes the foam beads to expand. The stream 14 then leaves the oven through a second exit 38, turns again, and reenters the oven through a third entrance 40. The binder curing is completed during this third and final pass through the oven. In addition, during this final pass the foam beads become fully expanded if they have not already done so.

The overall curing time (for the three passes) and temperature are critical. On one hand, if the oven temperature is too low or the oven time is too short, the binder will not cure completely. On the other hand, if the oven temperature is too high or the time is too long, the polystyrene beads after fully expanding will then contract to an unsuitably small diameter. The time and temperature values previously mentioned may therefore require adjustment to accommodate the operating conditions in a particular installation, to ensure complete curing while maintaining acceptably large bead diameters.

The binder, when it has cured, bonds substantially each fiber to—respectively—at least one other fiber. The same binder bonds substantially each foam bead to—respectively—at least one fiber. The entire mass of fibers and beads is thereby linked together into a lofted matting. Thus my new process produces an integral or unitary buoyant fiber product.

The conveyor chain 16 carries the fiber stream 14 out of the oven 20 through a third exit 42 and to ground level. A cutting device 44 cuts the fiber stream into convenient lengths, which are wound into rolls 45 for shipping.

2. Fibrous Product

Figure 2:
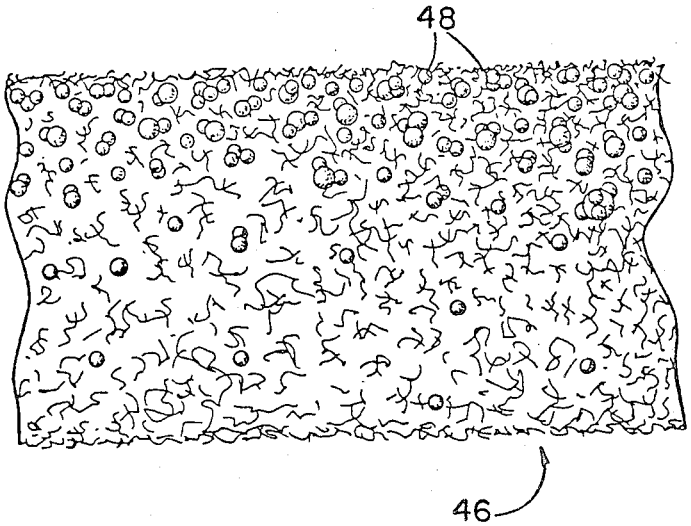
FIG. 2 shows a representative cross-section of a sample of the fiber product resulting from use of the FIG. 1 method.

FIG. 2 shows a cross-section of a sample of the final interbonded buoyant fiber product, generally indicated by the numeral 46. Each of the fiber strands is bonded to at least one other fiber by the binder at one or more points to form an integral unit. The expanded foam beads 48 are dispersed throughout the product, with the greater concentration being near—but below—the top surface, which was the surface closest to the bead dispenser 36 (FIG. 1). The beads are secured in place by the same binder which binds the individual fibers together.

The product is caused (by control of the feed rate of the bead dispenser 36) to have an average of approximately fifteen to fifty expanded beads per cubic inch of fiber. (An "expanded bead" for the purposes of this document means a bead whose diameter is at least three times the original unexpanded diameter.) Unexpanded or partially expanded beads are not counted. The number of foam beads required to impart the desired degree of buoyancy may require adjustment to compensate for variations in bead diameter and in the weight of the fiber and binder.

As already shown in detail, the novel buoyant fiber product of my invention can be easily manufactured using existing bonded-fiber processing equipment with very minor modifications. Equipment operators can readily convert the modified processing equipment back and forth between buoyant-fiber and nonbuoyant-fiber manufacture, without even shutting down the production line, by simply activating and deactivating the foam bead dispenser 36 (FIG. 1).

Fibers other than polyester may be found to be satisfactory, provided that the required wave-motion suppression properties are present. The fibers in the finished fibrous structure may be either nonwoven or loosely woven. It is preferable that they have a high loft.

In addition, buoyant particles other than foam beads may be used, provided that such particles are compatible with the binder and retain significant buoyancy following the curing process, which may or may not take place at an elevated temperature.

For waterbed applications, all components used should be resistant to degradation in water and resistant to chemicals that are commonly added to waterbed mattresses or to the water in such mattresses. As previously mentioned, high-temperature intimate contact between the polystyrene beads and vinyl sheeting (of the mattress or of other structures) is to be avoided.

This latter precaution avoids the problems resulting from the tendency of the plasticizer in the vinyl sheeting to be drawn from the vinyl into the polystyrene, essentially dissolving the polystyrene—which in the process loses its buoyancy—and leaving the vinyl brittle. As also mentioned earlier, the barrier which the resin coating forms on the beads may further help to chemically insulate the vinyl from the polystyrene. As a practical matter, some trial and error is likely to be required in finding an economic configuration in which the incidence of these problems is insignificant.

3. Direct Use of the Product as a Wave Absorber

Figure 3:
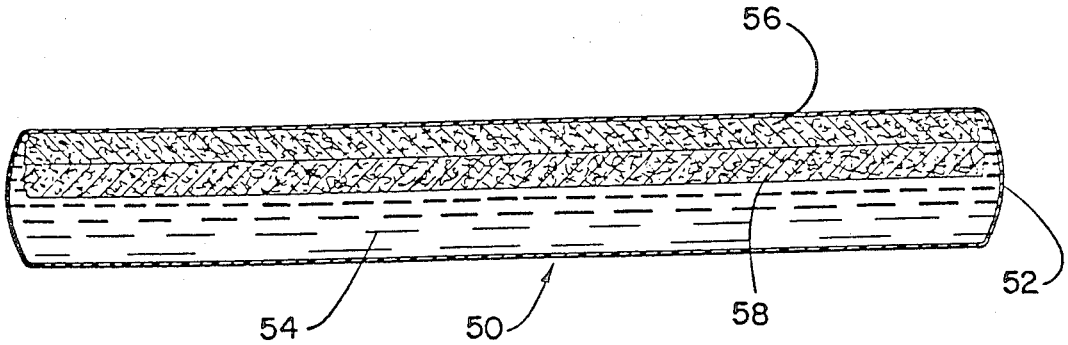
FIG. 3 is a side elevation, in section, of a waterbed mattress with the FIG. 2 fiber product installed for the purpose of suppressing wave motion and providing a firm sleeping surface.

FIG. 3 shows a cross-section of a waterbed mattress, generally designated by the numeral 50. The mattress is composed of a suitably shaped flexible outer envelope 52, made of polyvinyl or the like, which is typically nine inches deep, seventy-two inches wide, and eighty-four inches long. It is substantially filled with water 54.

Disposed within the envelope 52 are two pads 56 and 58 of buoyant fiber product of the type—and made by the process—just described. Each pad is roughly two inches thick, seventy-two inches wide and eighty-four inches long. The pads 56 and 58 are preferably laminated together using a suitable adhesive or by stitching or the like. Each pad is oriented with its surface having the greater bead concentration at the top.

The buoyant pads 56 and 58 float within, just below, and in contact with the upper panel of the envelope 52. The generally random, partially intertwined or interbonded structure formed by the polyester fibers and cured binder greatly dampen wave motion in the volume of water adjacent the occupant of the waterbed, without the necessity of filling substantially the entire envelope 52 with costly fiber. There is also a tendency to inhibit the formation of wave action, likewise by virtue of the buoyant position of the pads at the top of the water column. As previously mentioned, the buoyant pads have an advantageous tendency to distribute body impact across the top of the mattress, without conduction to the the water mass. It is preferable that the two pads be only slightly buoyant, especially the lower pad 58. If pad 58 is highly buoyant, it has a tendency to compress the upper pad 56, thereby reducing the loft of the pad and reducing the wave-motion suppressing qualities.

Unlike prior-art buoyant pads in the form of continuous sheets of foam material, my spaced-apart foam beads permit free passage of convection currents through my entire buoyant fiber structure. Accordingly, odor reduction is achieved, while the structures provided by my invention can be made thermally transparent—so that the water volume adjacent the waterbed user thereby can be uniformly and efficiently heated by a conventional, conventionally located heating unit. A sheet of closed-cell polyethylene that is forced against the bottom of the mattress, or that loses it buoyancy and sinks to the bottom of the mattress, produces the heater-related problems previously mentioned.

4. Float With Hanging Baffle

Figure 4:
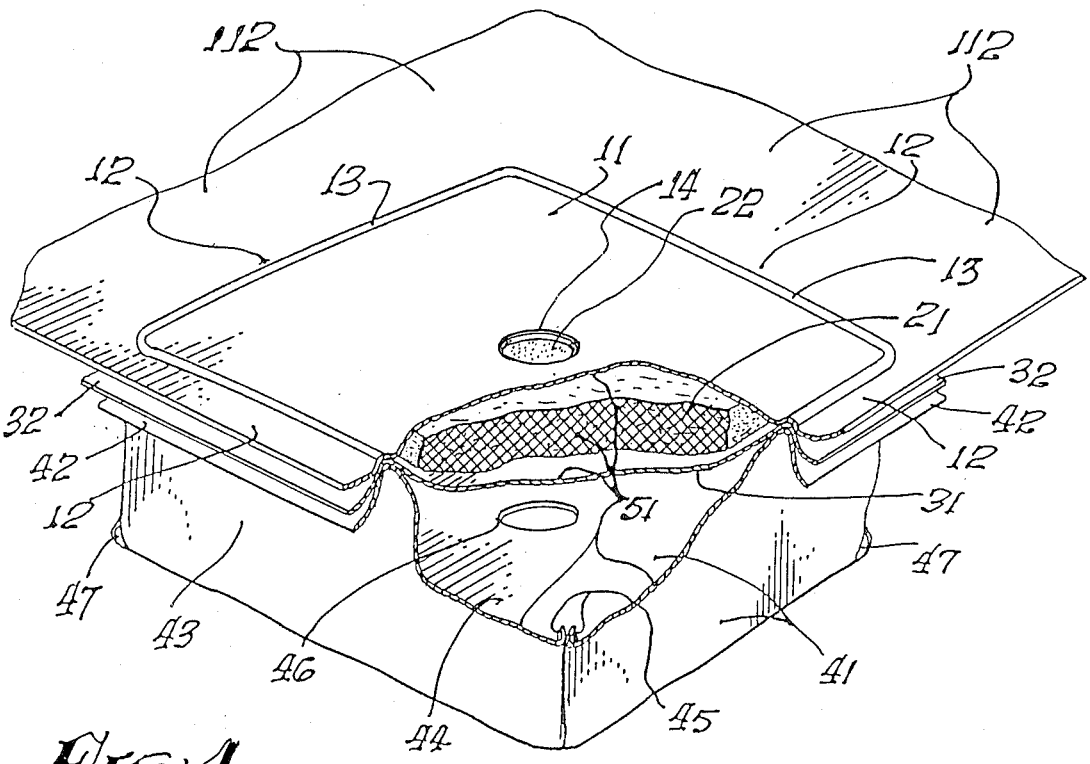
FIG. 4 is an isometric drawing, partly cut away and partly in section, showing a hydraulic chamber that is a preferred embodiment of my invention and that incorporates the FIG. 2 fiber product.
Figure 5:
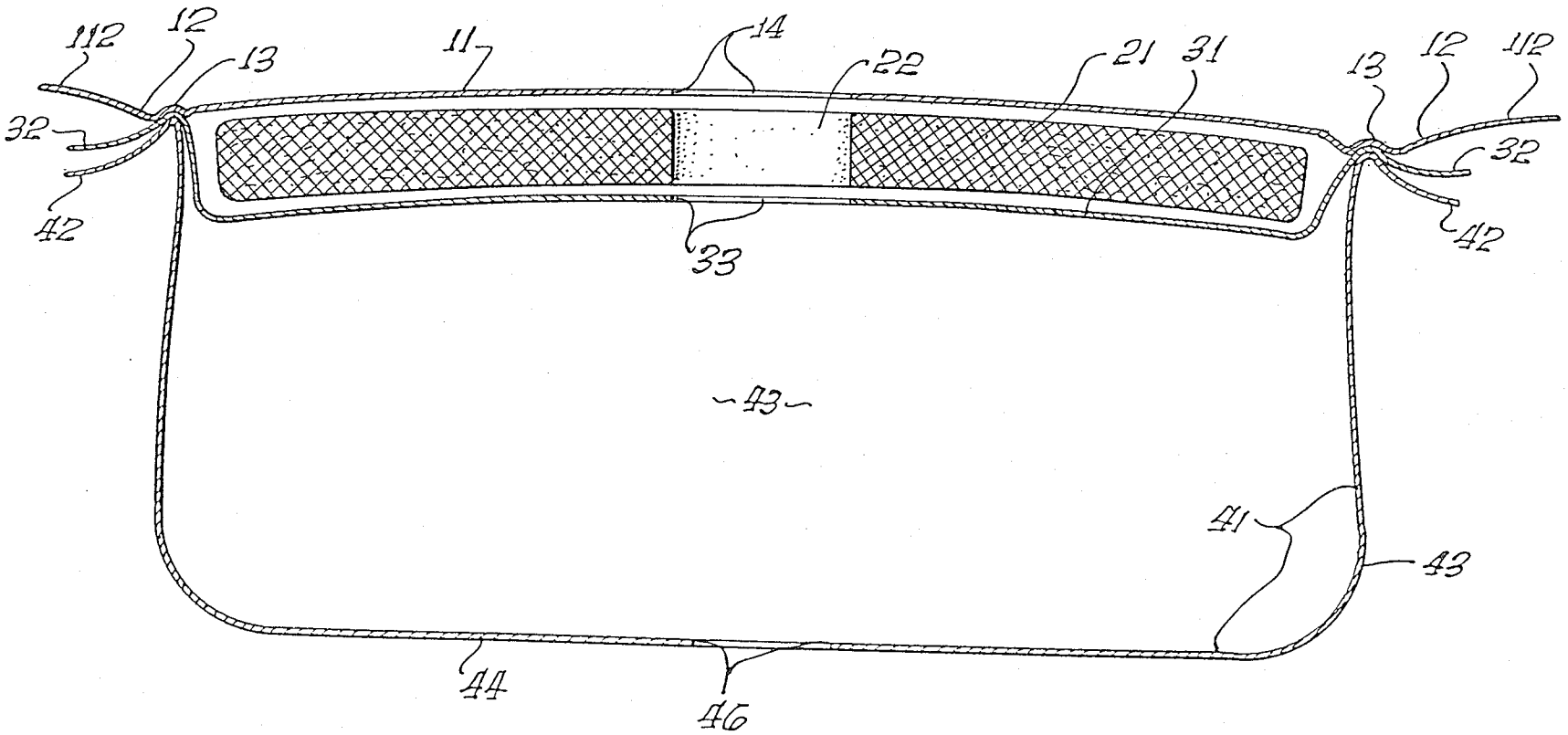
FIG. 5 is an elevation, mostly in section, of the Fig. 4 embodiment. For clarity

As shown in FIGS. 4 and 5, my buoyant fibrous product is advantageously usable as a float to suspend a baffle within a waterbed mattress. The entire structure shown in both FIGS. 4 and 5 is to be sealed within a waterbed mattress, which may otherwise be of generally conventional design. In use, water fills both the mattress and the space in and around the entire structure shown in these drawings. Most of the features in FIG. 4 are shown cut away at 51, to reveal the details of internal construction.

The article shown in these drawings includes a generally rectangular piece or pad of my fibrous product 21, incorporated into a partially enclosed vinyl or like plastic sheeting structure 11-31-41. One portion 41 of this sheeting structure forms a hanging baffle.

Advantageously the downwardly hanging parts 43 of this baffle portion 41 are continued in a generally horizontal part 44 that interconnects the downwardly hanging parts—creating, in effect, wall sections 43 and a floor section 44, to make a baffle of the type known as a "hydraulic chamber". Other baffle types, however, may be used within the scope of my invention.

The floor section 44 of the baffle portion 41 defines a generally central hole 46. The wall sections 43 are drawn together and fused in a weld seam along each of the four generally vertical corners of the chamber, with the tailing edges conveniently extended inward within the chamber as at 45. Two of these corner seams may, if desired, be extended all the way to the floor section 44; rather, apertures 47 may be left at the bottoms of some or all of the corners. I consider it particularly advantageous to have apertures at at least two diagonally opposite corners to facilitate drainage when the water is to be emptied from the mattress. It often happens that one side or quadrant of the baffle structure may come to rest in a slightly raised position, and this happenstance can trap water within the baffle structure if the raised portion also happens to be the only part that has a drainage aperture. Such trapping is almost always avoided by putting apertures in two diagonally opposite corners—since, if one or the other corner is raised, the opposite corner is almost always in a relatively very low position.

The sheeting structure 11-31-41 also includes a top sheet 11 that is secured to the baffle portion 41, and which constrains the fibrous pad 21 in close proximity to the baffle. The top sheet 11 may advantageously be square or rectangular, and of the same vinyl or like plastic material as the baffle portion 41. The two may be secured together as by a welded seam 13 running entirely or generally around the periphery of the top sheet 11, with the tailing edges 12 and 42 extending outward.

At least one of these edges, preferably the upper tailing edge 12, is in fact to be extended outwardly on some sides, as at 112, across a gap of several inches; and is continued as the corresponding top sheet 11 of another hydraulic chamber. The outer edges of the extension 112 are simply shown broken away, to limit the size of the drawing.

The top sheet 11 and the fibrous pad 21 advantageously have mutually aligned holes 14 and 22, respectively, for passage of entrapped air bubbles and of water between the interior of the hydraulic chamber 41 and the space above the top sheet 11. If these passages are not provided, trapped air generates an objectionable sloshing or gurgling sound within the mattress during use. Water flow through the matting is only a small effect, but under some circumstances it may be slightly helpful. These holes may be generally central as illustrated.

I prefer the geometry shown and discussed here because it is relatively quick to make, and because it produces a shape and a relationship between the fibrous pad 21 and the sheeting structure that will remain stable under typical conditions of use in a waterbed for years. Nevertheless the top sheet 11 need not be continuous or welded about its periphery to the baffle 41 as shown. It may instead be an assemblage of straps, strings, or other only-partially-covering elements that secure the fibrous pad 21 to the baffle 41. Such elements may if desired pass through or partially through the fibrous pad.

To further stabilize the configuration shown, I prefer to provide another piece of sheeting 31 between the fibrous pad 21 and the hydraulic chamber 41. This intermediate sheeting 31 may, if desired, be considered to be part of the constraining portion of the sheeting structure 11-31-42. Its principal function is to retain the pad 21 in proper relation to the baffle 41 when the waterbed mattress is emptied of water, moved around, packed for shipment and unpacked later, refilled with water, etc. Like the top sheet 11, this middle retaining structure 31 may be an assemblage of straps, strings, or other discrete elements rather than a continuous sheeting.

Under such conditions the fibrous pad 21 sometimes can become improperly oriented relative to the baffle 41 if there is no intermediate retaining sheeting 31. Reorienting the fibrous pad 21 can be very awkward, especially for owners of waterbeds who are not experienced at manipulating such articles, since as previously mentioned the entire structure of FIGS. 4 and 5 is sealed within a waterbed mattress.

This intermediate retaining sheeting 31 advantageously is secured to the top sheeting portion 11 and to the baffle portion 31 by the same welded seam 13 that secures the top 11 to the baffle 31. Thus the tailing edge 32 of the intermediate retaining sheeting 31 also extends outward from the seam 13, generally about the periphery of the structure. If desired, this tailing edge 32 may be used to form a continuous sheet interconnecting plural chambers as previously mentioned. In effect the top 11 and intermediate retainer 31 cooperate to form a shaped pocket within which the pad 21 is rather closely held, and cannot rotate, twist or tumble relative to the baffle portion 41.

The intermediate sheeting 31 also has a generally central hole 33, aligned with the holes 14 and 22 in the top 11 and pad 21. This hole 33 permits escape of entrapped air and facilitates water circulation between the interior of the hydraulic chamber and the space above the top 11—for the various purposes mentioned in the discussion of the other central holes 14 and 46.

As already explained the fibrous pad 21 in this assemblage performs a dual function. In addition to buoyant support of the hydraulic chamber 41—which attenuates motion of water within the enclosing waterbed mattress—the pad 21 also itself, by frictionally retarding the flow of water between its fibers, provides additional wave attenuation. It is to be understood that this effect is typically slight, but for some configurations may be significant. In order to perform this function the pad 21 must be exposed to the water within the mattress and/or within the hydraulic chamber 41. This exposure is an additional purpose of all three of the central holes 14, 33 and 46—in the top 11, intermediate retainer 31, and pad 21 respectively. The greater the water access to the fibrous product, the greater the significance of this second function of the pad 21.

When water permeates the fibrous product as just described, it becomes possible to logically regard the top sheeting 11, as well as the intermediate retainer 31, as forming part of the hydraulic chamber. For the purpose of definiteness of description and claims, however, in this document the hydraulic chamber is taken to be separate from the top sheeting 11 and intermediate retainer 31, and is thus limited to the lower portions which are designated by the reference numerals 41 and 44. Hence it is correct to say that the constraining elements 11 and 31 constrain the fibrous product 21 above the baffle 41—or above the hydraulic chamber 41-44.

It has previously been mentioned that polystyrene is preferable for the buoyancy beads of my new fibrous product. The advantage of polystyrene is even more important when the product is to be used to support a hanging baffle, such as a hydraulic chamber, because in this context the ramifications of a buoyancy failure are much more serious. These ramifications have already been set forth in the "Background" section (subsection 2[a]) above.

Polystyrene has a virtually indefinite life as a buoy. A representative of BASF Wyandotte, which is a supplier of this material, has informed me that water absorption by expanded polystyrene boards is "obviously negligible regarding flotation loss"—and that submersed expanded beads:

> "would yield even lower water absorption numbers. The moisture gain associated with the molded board is primarily a measurement of surface moisture and moisture in the interstitial spaces between beads. Polystyrene polymer is hydrophobic and does not absorb moisture."

This material is also used in structures intended for continual long-term water immersion—including boat hulls and docks. By contrast, when polyethylene (the favored prior-art material) is used in flotation devices and other immersibles its use customarily is limited to articles intended only for brief exposures, such as days, not weeks.

Through the use of polystyrene beads it becomes possible to use my preferred float-and-hanging-baffle geometry, in which the fibrous matting is exposed directly to the water in the waterbed mattress, and yet supports the baffle by flotation indefinitely.

Figure 6:
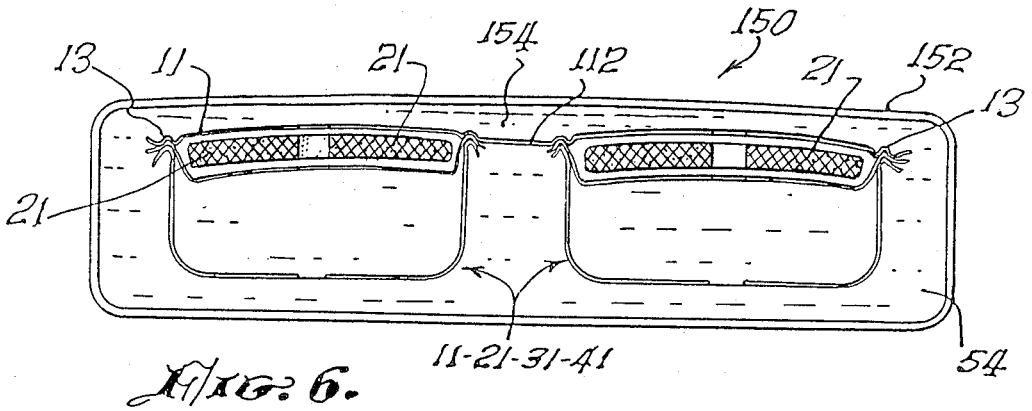
FIG. 6 is an end elevation, in section, of a waterbed mattress with the FIG. 4 combination installed for the purpose of suppressing wave motion.

In accordance with my invention plural pad-and-baffle combinations as illustrated in FIGS. 4 and 5, of such sizes and shapes as may be convenient, may be placed within a single waterbed mattress. FIG. 6 shows a cross-section of a waterbed mattress, generally designated by the numeral 150, which is generally similar in construction and dimensions to the previously described mattress 50 of FIG. 3. The envelope 152 of this mattress 150 is substantially filled with water 154.

Disposed within the envelope 152 are plural assemblies 11-21-31-41, each substantially as shown in FIGS. 4 and 5 and described in the foregoing text. These structures float within and just below the upper panel of the envelope 152. The baffle portions of each structure, and also the generally random, partially intertwined or interbonded structure formed by the polyester fibers and cured binder, greatly inhibit the formation of waves and dampen wave motion in the volume of water adjacent the occupant of the waterbed. Purely as examples, each of the structures 11-21-31-41 may be roughly twenty inches square and eight inches tall.

To avoid their sliding over and under one another in use or during filling or draining, they should be attached together by bridging members 112, preferably formed as the extensions of the individual top sheets 11 outside the sealing beads 13 (FIGS. 4 and 5). In other words, a single large sheet is used to form all of the top sheets 11 and the bridging members 112. If desired, for additional strength and stability this same arrangement may be used for two of the sheets—for example, the intermediate sheet 33 as well as the top sheet 11—or even for all three of the sheets.

In any event, the buoyantly suspended hydraulic chambers are connected together so that they form a unitary array such as a checkerboard pattern. It is advantageous to position the bridging sheets at the tops of the chamber assemblies, as that is where the best control of the buoyant forces is obtained.

5. Conclusion

Although preferred embodiments of my novel fiber product, manufacturing method, and float with hanging baffle using the novel fiber product have been disclosed, it will be apparent to those familiar with the art that modifications can be made without departing from the scope of the invention—which is defined only by the appended claims.

I claim:

1. In combination, for use within a waterbed mattress or the like to reduce wave motion of water therein:

- a bouyant, readily water-permeable and therefore heat-convection-transparent fibrous product comprising:
  - a large multiplicity of noncelliform, interbonded fibers in the form of a lofted matting that is readily water-permeable throughout, and
  - a large multiplicity of expanded foam beads secured to and among the fibers, and spaced apart singly or in clusters among the fibers to maintain the lofted matting readily water-permeable throughout;
- a sheeting structure that forms a baffle for use in reducing such wave motion; and means for constraining the fibrous product in close proximity to the baffle, so that the fibrous product can by its buoyancy support the baffle.

2. The combination of claim 1 wherein:

the beads are secured to the fibers by a binder.

3. The combination of claim 2 wherein:

the binder that secures the beads to the fibers also interbonds the fibers.

4. The combination of claim 1 wherein:

the sheeting structure and the constraining means are only partially enclosed;

whereby such water within such mattress or the like, when it fills the space in and around the sheeting structure and the constraining means, can circulate in and through the fiber product; such circulation having the effect of further reducing such wave motion.

5. The combination of claim 1 wherein:

the constraining means constrain the fibrous product above the baffle.

6. The combination of claim 1 wherein:

the baffle is in the form of a hydraulic chamber.

7. The combination of claim 6 wherein:

the constraining means and the hydraulic chamber are only partially enclosed;

whereby such water within such mattress or the like, when it fills the space in and around the constraining means and the hydraulic chamber, can circulate in and through the fiber product and also in and through the hydraulic chamber; such circulation having the effect of further reducing such wave motion.

8. The combination of claim 1, for use in such a waterbed that comprises an upper panel made at least in part of vinyl sheeting; and wherein:

the baffle is formed by a first portion of the sheeting structure; and the constraining means are formed by a second portion of the sheeting structure and comprise a vinyl element that extends over, and is in direct contact with, at least a portion of the upper surface of the fibrous matting;

the fibrous matting, when the said combination is installed in such a waterbed, may be partially exposed for contact with such top panel of said waterbed; and the beads comprise polystyrene, and the distribution of the beads among the fibers is nonuniform, being very small or zero along the upper surface of the fibrous matting;

whereby when the said combination is in use there is very little or non contact between polystyrene and vinyl within such waterbed.

9. The combination of claim 8 wherein:

the beads are secured to the fibers by a binder.

10. The combination of claim 9 wherein:

the binder that secures the beads to the fibers also interbonds the fibers.

11. The combination of claim 8 wherein:

the baffle and the constraining means are only partially enclosed;

whereby such water within such mattress or the like, when it fills the space in and around the baffle and the constraining means, can circulate in and through the fiber product; such circulation having the effect of further reducing such wave motion.

12. The combination of claim 8 wherein:

the constraining means constrain the fibrous product above the baffle.

13. The combination of claim 8 wherein:

the baffle is in the form of a hydraulic chamber.

14. The combination of claim 13 wherein:

the constraining means and the hydraulic chamber are only partially enclosed;

whereby such water within such mattress or the like, when it fills the space in and around the constraining means and the hydraulic chamber, can circulate in and through the fiber product and also in and through the hydraulic chamber; such circulation having the effect of further reducing such wave motion.

15. The combination of claim 6 wherein the hydraulic chamber has apertures in diagonally opposite lower corners.

16. A plurality of the combinations defined in claim 1, connected together by a bridging member.

17. The combination of claim 1 wherein the foam beads are of polystyrene.

18. The combination of claim 3 wherein the foam beads are of polystyrene.

19. The combination of claim 6 wherein the foam beads are of polystyrene.

20. In combination. for use within a waterbed mattress or the like to reduce wave motion of water therein:

a buoyant, readily water-permeable and therefore heat-convection-transparent fibrous product comprising:

a large multiplicity of interbonded noncelliform fibers in the form of a lofted matting that is readily water-permeable throughout, and a large multiplicity of expanded foam beads secured to and among the fibers, and spaced apart singly or in clusters among the fibers to maintain the lofted matting readily water-permeable throughout;

a sheeting structure that forms a baffle; said baffle having the effect, when placed in the water within such a waterbed mattress, of reducing such wave motion; and means for suspending the baffle from the fibrous product, so that the fibrous product can by its buoyancy, when placed in the water within such a waterbed mattress, support the baffle; said baffle-suspending means also having the effect of reducing such wave motion.

* * * * *